US012807398B2

(12) United States Patent
Terrasi et al.

(10) Patent No.: US 12,807,398 B2
(45) Date of Patent: Nov. 24, 2026

(54) SHIPPING COVER ASSEMBLY FOR A TRANSMISSION HOUSING

(71) Applicant: DANA ITALIA S.R.L., Arco (IT)

(72) Inventors: Gianluca Terrasi, Arco (IT); Davide Deimichei, Arco (IT); Gianmario Ravasi, Arco (IT); Viviana Enei, Arco (IT)

(73) Assignee: DANA ITALIA S.R.L., Arco (IT)

( * ) Notice: Subject to any disclaimer, the term of this patent is extended or adjusted under 35 U.S.C. 154(b) by 126 days.

(21) Appl. No.: 18/913,801

(22) Filed: Oct. 11, 2024

(65) Prior Publication Data

US 2025/0122005 A1 Apr. 17, 2025

(30) Foreign Application Priority Data

Oct. 12, 2023 (DE) ..... 20 2023 105 896.5

(51) Int. Cl.
*B65D 85/68* (2006.01)
*B65D 81/05* (2006.01)

(52) U.S. Cl.
CPC ..... *B65D 85/68* (2013.01); *B65D 81/05* (2013.01); *B65D 2585/6867* (2013.01)

(58) Field of Classification Search
CPC ..... B65D 85/68; B65D 81/05; B65D 2585/6867; F16H 57/00; F16H 2057/0093; F16H 57/031
See application file for complete search history.

(56) References Cited

U.S. PATENT DOCUMENTS

| | | | | |
|---|---|---|---|---|
| 4,815,884 | A * | 3/1989 | Halliday, Jr. | B25B 27/0028 403/17 |
| 8,783,133 | B2 * | 7/2014 | Pietras | F16J 15/3268 74/609 |
| 10,677,342 | B2 * | 6/2020 | Ramirez Ortiz | F16B 5/0664 |
| 11,313,472 | B2 * | 4/2022 | Arobbio | F16J 15/3268 |
| 11,859,706 | B1 * | 1/2024 | Wilcox | F16H 57/02 |
| 2007/0157759 | A1 * | 7/2007 | Englund | F16J 15/3268 74/606 R |

* cited by examiner

*Primary Examiner* — Thomas C Diaz
(74) *Attorney, Agent, or Firm* — McCoy Russell LLP

(57) ABSTRACT

The present disclosure relates to a shipping assembly comprising a transmission housing forming an open cavity, a shipping cover assembly, and a gear. The shipping cover assembly comprises a cover portion connected to the transmission housing and closing the open cavity of the transmission housing, an inner side of the cover portion facing the transmission housing, and a stub shaft portion protruding from the inner side of the cover portion and into the open cavity of the transmission housing. The gear is received on the stub shaft portion of the shipping cover assembly.

19 Claims, 8 Drawing Sheets

SHIPPING COVER ASSEMBLY FOR A TRANSMISSION HOUSING

CROSS REFERENCE TO RELATED APPLICATION

The present application claims priority to German Utility Model Application No. 20 2023 105 896.5, entitled "SHIPPING COVER ASSEMBLY FOR A TRANSMISSION HOUSING", filed Oct. 12, 2023. The entire contents of the above-identified application is hereby incorporated by reference for all purposes.

TECHNICAL FIELD

The present disclosure relates to a shipping cover assembly for a transmission housing and to a shipping assembly including a transmission housing and said shipping cover assembly.

BACKGROUND AND SUMMARY

Typically, a transmission housing, for example a housing of a transmission for an automotive vehicle, forms or includes a cavity inside of which a plurality of shafts and gears may be mounted. However, when shipping the transmission, the transmission housing and the gears to be assembled inside the transmission housing are usually shipped separately. This may entail additional logistical effort both on the part of the sender and on the part of the recipient, thereby increasing overall production costs.

Thus, there is demand for means which decrease the overall cost of production of a transmission.

This demand is met by a shipping cover assembly for a transmission housing, and by a shipping assembly including said shipping cover assembly according to the present disclosure.

The presently proposed shipping cover assembly for a transmission housing comprises:

- a cover portion having an inner side, and
- a stub shaft portion protruding from the inner side of the cover portion, the stub shaft portion configured to receive a gear thereon.

For example, when shipping a transmission housing covered by the cover portion of the shipping cover assembly, a gear may be placed on the stub shaft portion so that the transmission housing and the gear placed on the stub shaft portion may be shipped together, thereby reducing logistical complexity and overall costs. Typically, during shipment of the transmission housing the cover portion covers an opening of a cavity formed or included in the transmission housing, wherein the inner side of the cover portion faces the cavity. The fact that the stub shaft portion protrudes from the inner side of the cover portion may then allow the gear to be placed inside the cavity of the transmission housing during shipment so that the gear may be protected by the transmission housing. Further, placing the gear on the stub shaft portion and inside the cavity during shipment does not require additional space for storing the gear.

The cover portion and the stub shaft portion may be formed in one piece. For example, the cover portion and the stub shaft portion may be formed by moulding or casting, such as by using a single mould or cast. However, it is understood that in some embodiments the cover portion and the stub shaft portion may be configured as separate pieces which are connected to one another. In some embodiments, the cover portion and the stub shaft portion may be bonded to one another, for example by adhesive bonding or by welding. Additionally or alternatively, the cover portion and the stub shaft portion may be connected to one another by connecting members such as screws, rivets or bolts.

One or both of the cover portion and the stub shaft portion may be made of a plastic material. However, it is understood that, alternatively, one or both of the cover portion and the stub shaft portion may be made of other materials such as metal.

The stub shaft portion may include or form a receptacle for detachably receiving a fastening member therein, such as a screw, a rivet or a bolt. In this way, a gear may be detachably fastened or secured on the stub shaft portion using the fastening member. It is understood that in some embodiments the shipping cover assembly may include another mechanism for fastening or securing a gear on the stub shaft portion, for example a clamp, a quick release, or a latching mechanism.

The shipping cover assembly may further comprise a sealing member disposed on the inner side of the cover portion. The sealing member may extend circumferentially around the cover portion. More specifically, the sealing member may extend circumferentially at or near a rim or edge of the cover portion. For instance, the sealing member may be injection-moulded on or glued to the inner side of the cover portion.

The cover portion may comprise a flange portion. The sealing member may then be disposed on the inner side of the flange portion of the cover portion.

The cover portion may include a fitting portion configured to be received in an opening of a transmission housing, for example in a positive fit. The flange portion may protrude outwardly from the fitting portion at a right angle.

The cover portion may include a tapered portion connected to the stub shaft portion. For example, the tapered portion may connect the stub shaft portion to the fitting portion of the cover portion. Connecting the stub shaft portion to a tapered portion of the cover portion may grant the stub shaft portion a high degree of stability.

The cover portion may feature or include a plurality of through holes for receiving connecting members configured to connect the cover portion to a transmission housing. For example, the plurality of through holes may be disposed in the flange portion of the cover portion.

The presently proposed shipping assembly comprises:

- a transmission housing forming an open cavity,
- the above-described shipping cover assembly, wherein the cover portion is connected to the transmission housing and closes the open cavity of the transmission housing, wherein the inner side of the cover portion faces the transmission housing, and wherein the stub shaft portion protrudes into the cavity of the transmission housing, and
- a gear received on the stub shaft portion of the shipping cover assembly.

The shipping assembly may further comprise a fastening member such as a screw, a rivet or a bolt detachably received in the above-described receptacle formed by the stub shaft portion. For example, the fastening member may be configured to fix or secure the gear on the stub shaft portion.

The above-described sealing member disposed on the inner side of the cover portion may be in sealing contact with a sealing face of the transmission housing. The sealing face of the transmission housing may extend circumferentially around an opening of the open cavity of the transmission housing. For example, the above-described flange portion of the cover portion and the sealing face of the transmission housing may be arranged in parallel.

The shipping assembly may further comprise a plurality of connecting members connecting the shipping cover assembly to the transmission housing. For example, the connecting members may press the cover portion or, more specifically, the flange portion of the cover portion of the shipping cover assembly against the sealing face of the transmission housing. In this way, the flange portion of the cover portion may form a mechanical stop which limits movement of the cover portion relative to the transmission housing.

The cover portion of the shipping cover assembly, for example the above-described fitting portion of the cover portion, may be received or may be configured to be received in an opening of the open cavity of the transmission housing in a form-fit or positive fit.

Embodiments of the presently proposed shipping assembly and shipping cover assembly are depicted in the figures and are described in the following detailed description.

DETAILED DESCRIPTION

Figure 1:
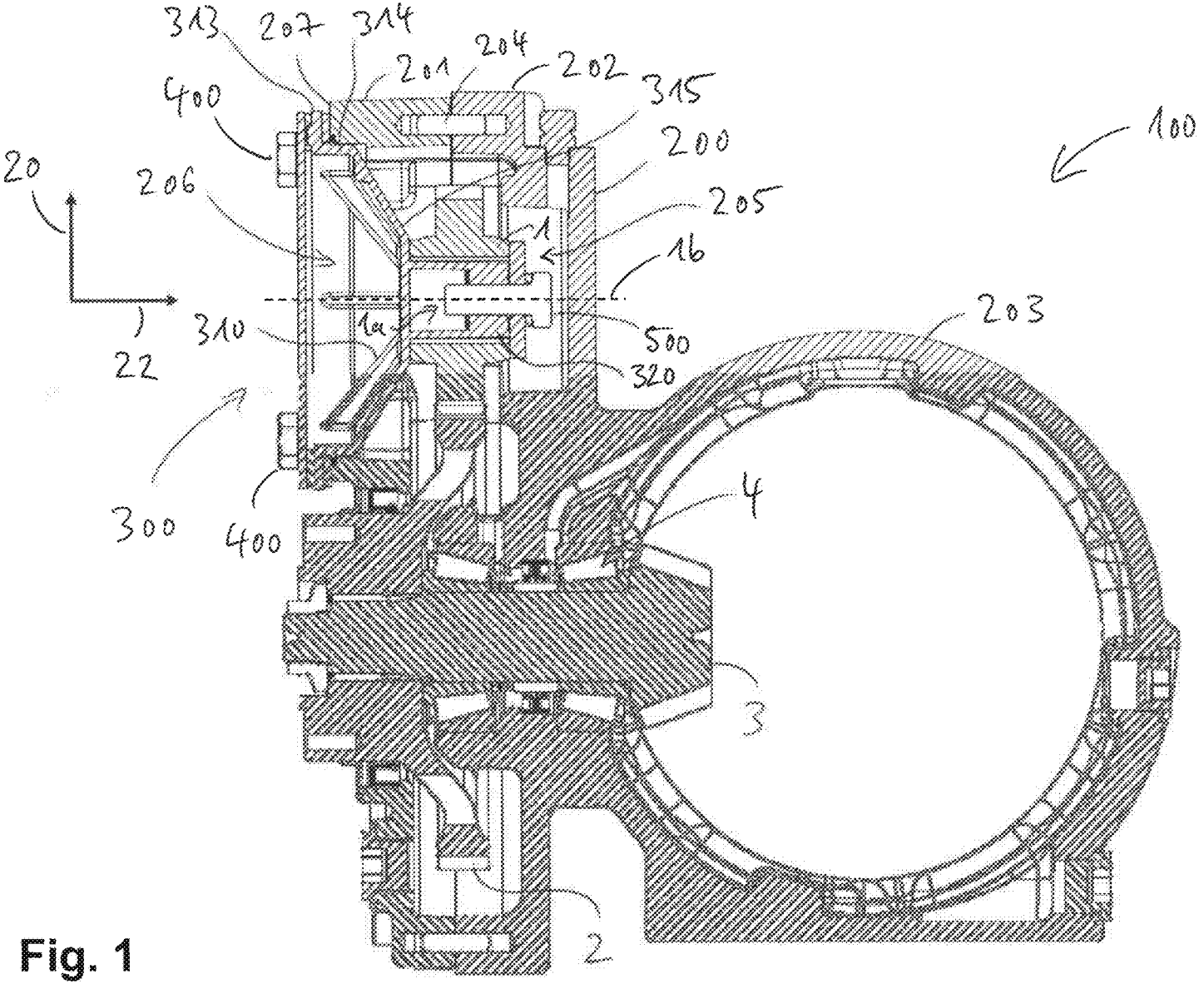
FIG. 1 schematically shows a first sectional view of an embodiment of a shipping assembly including a transmission housing, a shipping cover assembly and a gear mounted on the shipping cover assembly.
Figure 2:
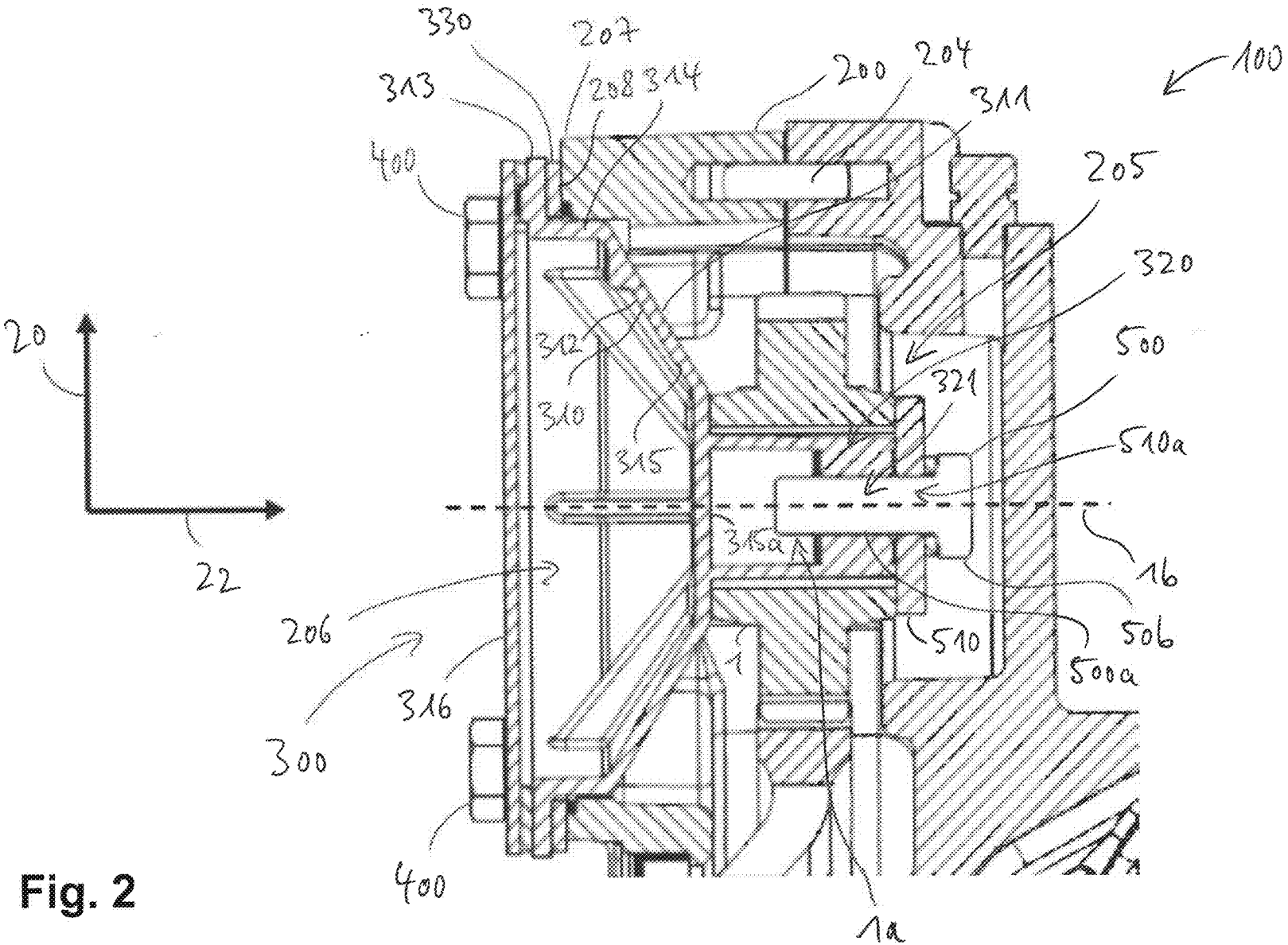
FIG. 2 shows a detail of FIG. 1.

FIG. 1 illustrates a first sectional view of a shipping assembly 100 of the presently proposed type. The shipping assembly includes a transmission housing 200, a shipping cover assembly 300 mounted on the transmission housing 200, and a first gear 1 mounted on the shipping cover assembly 300. The transmission housing 200 includes or forms an open cavity 205. In FIG. 1, the sectional plane is arranged in parallel to the x-z-plane of a right handed Cartesian coordinate system having an x-axis 20 and a z-axis 22. A detail of FIG. 1 showing a part of the open cavity 205 of the transmission housing 200 and a part of the shipping cover assembly 300 is depicted in FIG. 2. Here and in all of the following, features recurring in different figures are designated with the same reference signs.

FIG. 1 may depict a situation in which the shipping assembly 100 including the transmission housing 200 and the first gear 1 is shipped or stored, for example. In this situation, the shipping cover assembly 300 mounted on the transmission housing 200 may protect the transmission housing 200 or a portion thereof from dirt and may prevent other goods or items from getting stuck in the transmission housing 200. The transmission housing 200 may be configured to house shafts and gears of a transmission, such as for an automotive vehicle. For example, the first gear 1 may be configured to be disposed in the transmission housing 200 or mounted on a shaft disposed in the transmission housing 200 to form part of a transmission including the transmission housing 200 and the first gear 1.

In the specific embodiment depicted in the figures, the transmission housing 200 comprises a first housing portion 201 and a second housing portion 202. The housing portions 201, 202 may be connected by connecting elements 204 such as screws, rivets or bolts. It is understood that in other embodiments not depicted here, the transmission housing 200 may be formed as a single piece or that the transmission housing 200 may include more than two separate pieces. Here, the second housing portion 202 is further formed in one piece with an axle housing 203. The transmission housing 200 may include or may be made of metal such as cast iron or aluminium, for example. In the embodiment depicted in FIG. 1, the shipping assembly 100 also includes a pinion shaft 3, a second gear 2 mounted on and drivingly engaged with the pinion shaft 3, and a bearing 4 rotatably mounting the pinion shaft 3 on the transmission housing 200. The pinion shaft 3 may be configured to drive a crown gear of a differential which may be mounted in the axle housing 203, for example. It is understood that other embodiments of the shipping assembly 100 may not include a pinion shaft, a second gear, or a bearing.

The shipping cover assembly 300 comprises a cover portion 310 and a stub shaft portion 320. An inner side 311 of the cover portion 310 faces the transmission housing 200 and the open cavity 205. An outer side 312 of the cover portion 310 faces away from the transmission housing 200 and from the open cavity 205. In the embodiment depicted in the figures, the shipping cover assembly 300 further comprises a lid 316 disposed on the outer side 312 of the cover portion 310. The shipping cover assembly 300, or, more specifically, the cover portion 310 closes or is configured to close the open cavity 205 of the transmission housing 200. The stub shaft portion 320 protrudes from the inner side 311 of the cover portion 310 and into the open cavity 205 of the transmission housing 200. In other words, when the shipping cover assembly 300 is mounted on the transmission housing 200, as shown in FIG. 1, the stub shaft portion 320 is arranged or at least partially arranged inside the open cavity 205 of the transmission housing 200.

Figure 7:
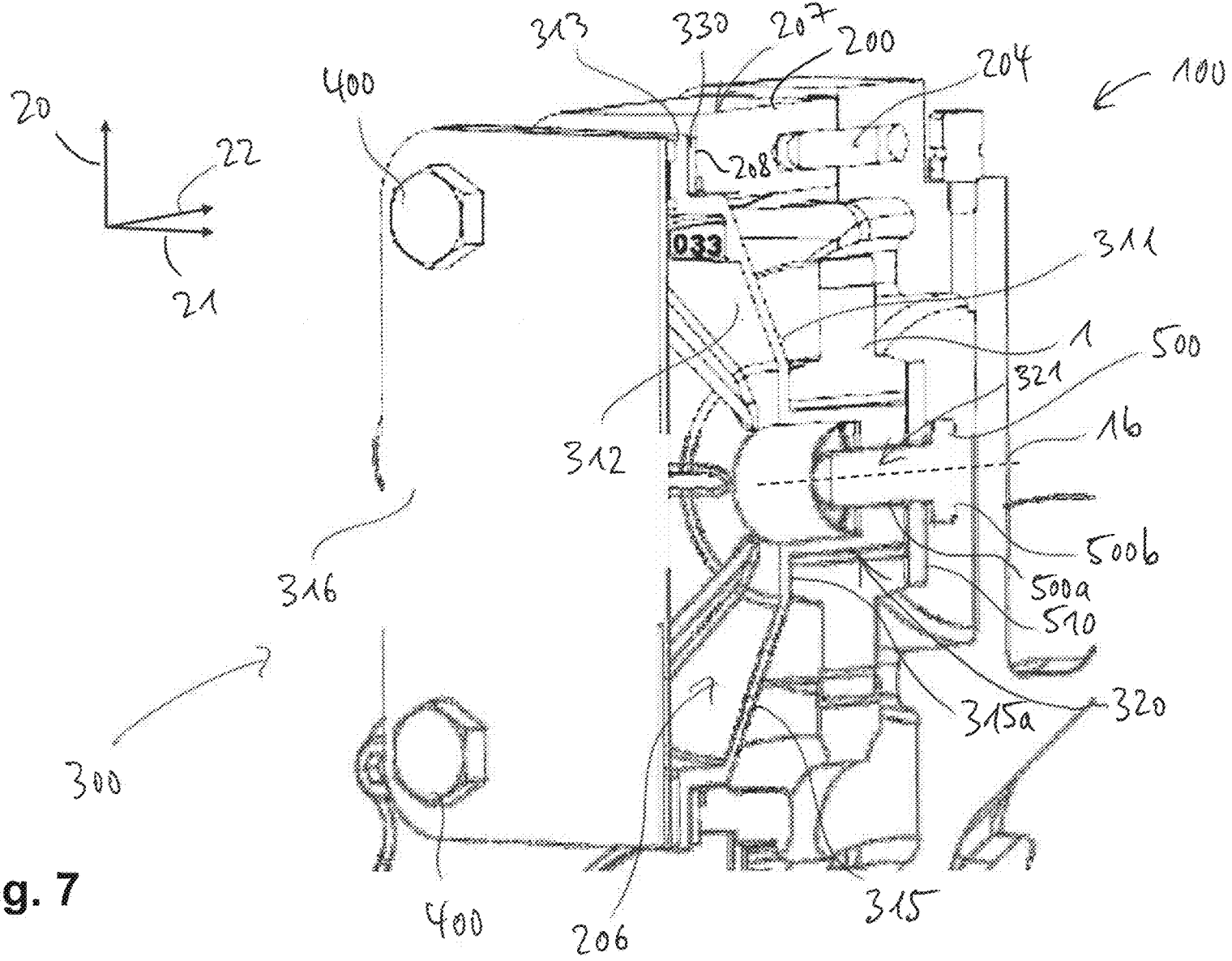
FIG. 7 shows a detail of FIG. 6.

As can best be seen in FIGS. 2 and 7, the cover portion 310 of the shipping cover assembly 300 includes a flange portion 313, a fitting portion 314, and a tapered portion 315. In the embodiment shown in the figures, the stub shaft portion 320 is connected to and extends or protrudes from the tapered portion 315 of the cover portion 310, more specifically from an end face 315*a* of the tapered portion 315. Here, the fitting portion 314 of the cover portion 310 is arranged in parallel to the z-axis 22, and the flange portion 313 extends or protrudes outwardly from the fitting portion 314 at a right angle. That is, in the embodiment depicted in the figures, the flange portion 313 is arranged in parallel to the x-y-plane, where the y-axis 21 extends perpendicular to the plane of projection of FIGS. 1 and 2.

As can be seen in FIGS. 1 and 2, for example, the shipping cover assembly 300 may be inserted into the open cavity 205 of the transmission housing 200 in the positive z-direction 22 until the flange portion 313 is supported on a rim portion 207 of the transmission housing 200 which encloses an opening 206 of the open cavity 205. The cover portion 310 or, more specifically, the fitting portion 314 of the cover portion 310, is received or is shaped to be received in the the open cavity 205 of the transmission housing 200 in a form-fit. Or in other words, the cover portion 310 or, more specifically, the fitting portion 314 and the rim portion 207 of the transmission housing 200 are shaped such that when the cover portion 310 or, more specifically, the fitting portion 314 is fully inserted into the open cavity 205 and the flange portion 313 is supported on the rim portion 207 of the transmission housing 200, the rim portion 207 prevents movement of the shipping cover assembly 300 relative to the transmission housing 200 in directions parallel to the x-y-plane.

The shipping assembly 100 further includes connecting members 400 connecting or configured to connect the shipping cover assembly 300 or, more specifically, the cover portion 310 to the transmission housing 200 when the cover portion 310 is fully inserted into the open cavity 205 of the transmission housing 200, as shown in the figures. As can best be seen in FIGS. 3 and 4, the cover portion 310 may include a plurality of through holes 317 for receiving the connecting members 400. In the embodiment depicted in the figures, the through holes 317 are formed in the flange portion 313 of the cover portion 310. Here, the connecting members 400 are configured as screws. However, it is understood that in alternative embodiments the connecting members 400 may include other elements configured to detachably connect the shipping cover assembly 300 to the transmission housing 200, such as rivets, bolts, clamps, a latching mechanism, or the like.

The tapered portion 315 of the cover portion 310 extends or protrudes from the fitting portion 314 along the z-axis 22 and away from the flange portion 313. A diameter or a maximum diameter of the tapered portion 315 in the x-y-plane descreases along the z-axis 22 and toward the stub shaft portion 320. The flange portion 313 is connected to the tapered portion 315 via the fitting portion 314. The end face 315*a* of the tapered portion 315 extends in parallel to the flange portion 313, i. e. in parallel to the x-y-plane.

The stub shaft portion 320 extends along the z-axis 22, i. e. at a right angle with respect to the flange portion 313 and the end face 315*a* of the tapered portion 315. The stub shaft portion 320 has a cylindrical or an essentially cylindrical outer surface 321. In the embodiment depicted in the figures, a maximum diameter 315*b* of the end face 315*a* of the tapered portion 315 in the x-y-plane, i. e. in parallel to the flange portion 313, is larger than a diameter or a maximum diameter of the stub shaft portion 320 parallel to the x-y-plane. In this way, the tapered portion 315 or the end face 315*a* of the tapered portion 315 forms a mechanical stop for the first gear 1 when the first gear 1 is received on the stub shaft portion 320, as shown in FIGS. 1, 2, 5 and 6, for example.

In the embodiment depicted in the figures, the cover portion 310 and the stub shaft portion 320 are formed in one piece. Both the cover portion 310 and the stub shaft portion 320 may be made of a plastic material. For instance, the cover portion 310 and the stub shaft portion 320 may be formed in a moulding process. For example, the cover portion 310 and the stub shaft portion 320 may be formed in the same mould. Alternatively, it is conceivable that both the cover portion 310 and the stub shaft portion 320 include or are made of a metal. The cover portion 310 and the stub shaft portion 320 may be formed in a casting process. For example, the cover portion 310 and the stub shaft portion 320 may be formed in the same cast. However, it is understood that in some embodiments the cover portion 310 and the stub shaft portion 320 may be configured as separate pieces which are connected or bonded to one another. For example, in some embodiments the cover portion 310 and the stub shaft portion 320 may be connected by connecting elements such as screws, rivets, or bolts. Additionally or alternatively, the cover portion 310 and the stub shaft portion 320 may be bonded to one another, for example by welding. It is further understood that in some embodiments the cover portion 310 and the stub shaft portion 320 may be made of different materials. For instance, the cover portion 310 and the stub shaft portion 320 may be made of plastic and metal, respectively, or vice versa.

The first gear 1 is received and mounted on the stub shaft portion 320. It may be envisaged that in an assembled state of the transmission including the transmission housing 200 and the first gear 1, the first gear 1 is disposed or mounted inside the open cavity 205 of the transmission housing 200. The first gear 1 includes or forms an opening or through hole 1*a* which allows the first gear 1 to be slid on the stub shaft portion 320. Both the first gear 1 and the trough hole 1*a* are arranged symmetrically with respect to the rotation axis 1*b* of the first gear 1.

In FIG. 1, the opening or through hole 1*a* extends through the first gear 1 along the z-axis 22 and the stub shaft portion 320 is received in the through hole hole 1*a* formed by the first gear 1. For example, when the first gear 1 is mounted on the stub shaft portion 320 as shown in FIGS. 1 and 2, the first gear 1 may be received on the stub shaft portion 320 in a form-fit, thereby preventing movement of the first gear 1 relative to the shipping cover assembly 300 or relative to the stub shaft portion 320 in the x-y-plane. For instance, both the stub shaft portion 320 of the shipping cover assembly 300 and the through hole 1*a* extending through the first gear 1 may have correspondingly shaped cylindrical cross sections.

The shipping assembly 100 further includes a fastening member 500 which is detachably received or configured to be detachably received in a receptacle 321 formed by the stub shaft portion 320 to secure the first gear 1 on the stub shaft portion 320 when the first gear 1 is mounted or received on the stub shaft portion 320, as shown in FIGS. 1 and 2, for example. In the embodiment depicted in the figures, the fastening member 500 is a bolt or gudgeon having an elongate body portion 500*a* and a head portion 500*b*, wherein a diameter of the head portion 500*b* is larger than a diameter of the body portion 500*a*. The shipping assembly 100 further comprises a punched washer 510 having a through hole 510*a*. A maximum diameter of the through hole 510*a* formed by the washer 510 in parallel to the x-y-plane is smaller than a maximum diameter of the head portion 500*b* of the fastening member 500 in parallel to the x-y-plane. In FIG. 1, the flat washer 500 is arranged or oriented in parallel to the x-y-plane. The washer 510 is received on the fastening member 500 in a form-fit. Or in other words, the fastening member 500 is received in the through hole 510*a* formed by the washer 510 and extends through the washer 510. Along the z-axis 22, the washer 510 is disposed in between the head portion 500*b* of the fastening member 500 and the stub shaft portion 320. The fastening member 500 attaches or fixes the washer 510 to the shipping cover assembly 300. More specifically, the head portion 500*b* of the fastening member 500 attaches or fixes the washer 510 to the stub shaft portion 320. A maximum diameter of the washer 510 is larger than a maximum diameter of the stub shaft portion 320 on which the first gear 1 is mounted, wherein the maximum diameter of the washer 510 and the maximum diameter of the stub shaft portion 320 are determined parallel to the x-y-plane, respectively. Further, the maximum diameter of the washer 510 is larger than a maximum diameter of the through hole 1*a* formed by the first gear 1. In this way, the washer 510 limits axial movement of the first gear 1 relative to the stub shaft portion 320 when the first gear 1 is mounted or received on the stub shaft portion 320. For example, the fastening member 500 may press the first gear 1 against the end face 315*a* of the tapered portion 315 of the cover portion 310 of the shipping cover assembly 300 to fix or secure the first gear 1 on the shipping cover assembly 300.

Figure 3:
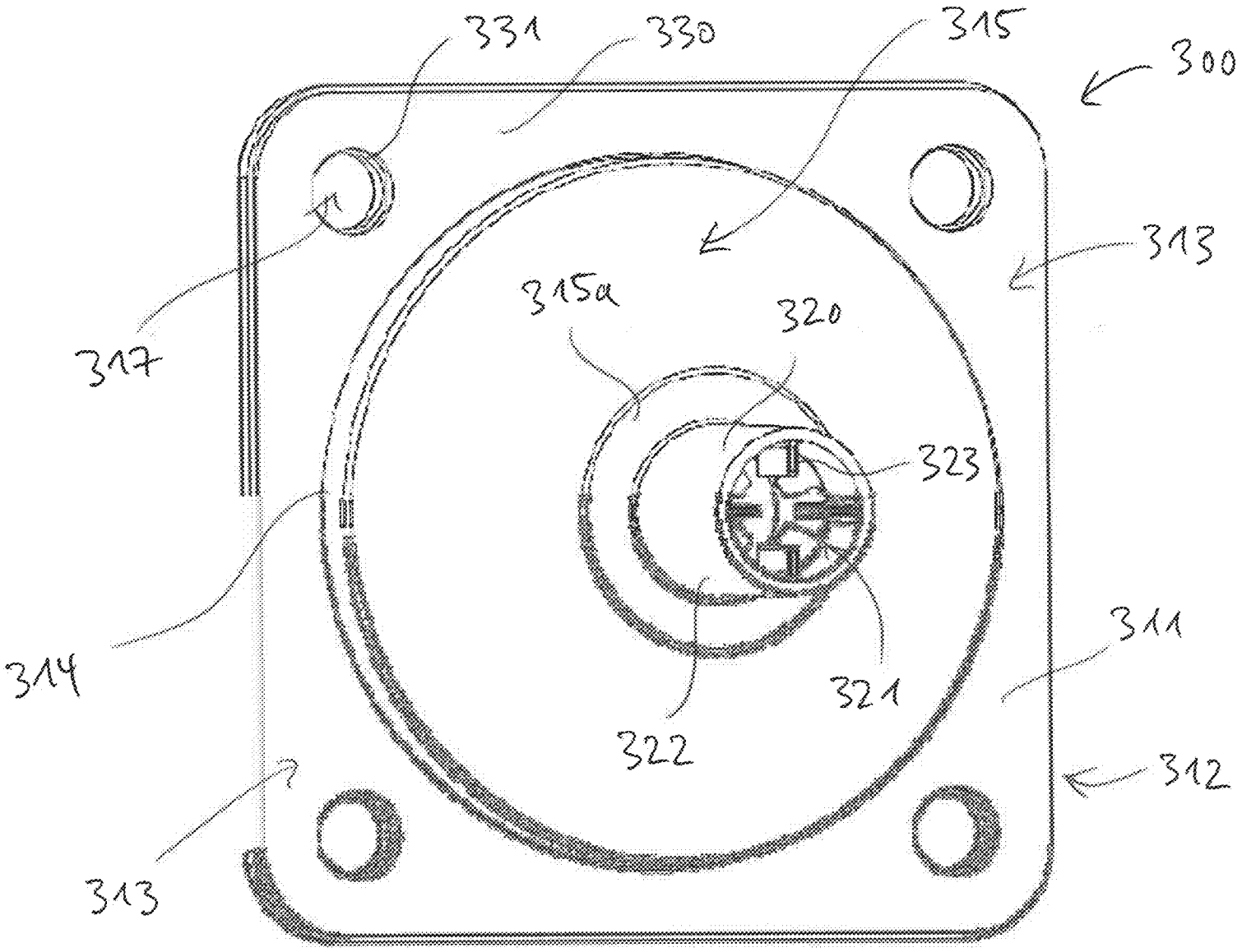
FIG. 3 schematically shows a perspective view of an embodiment of a shipping cover assembly.
Figure 4:
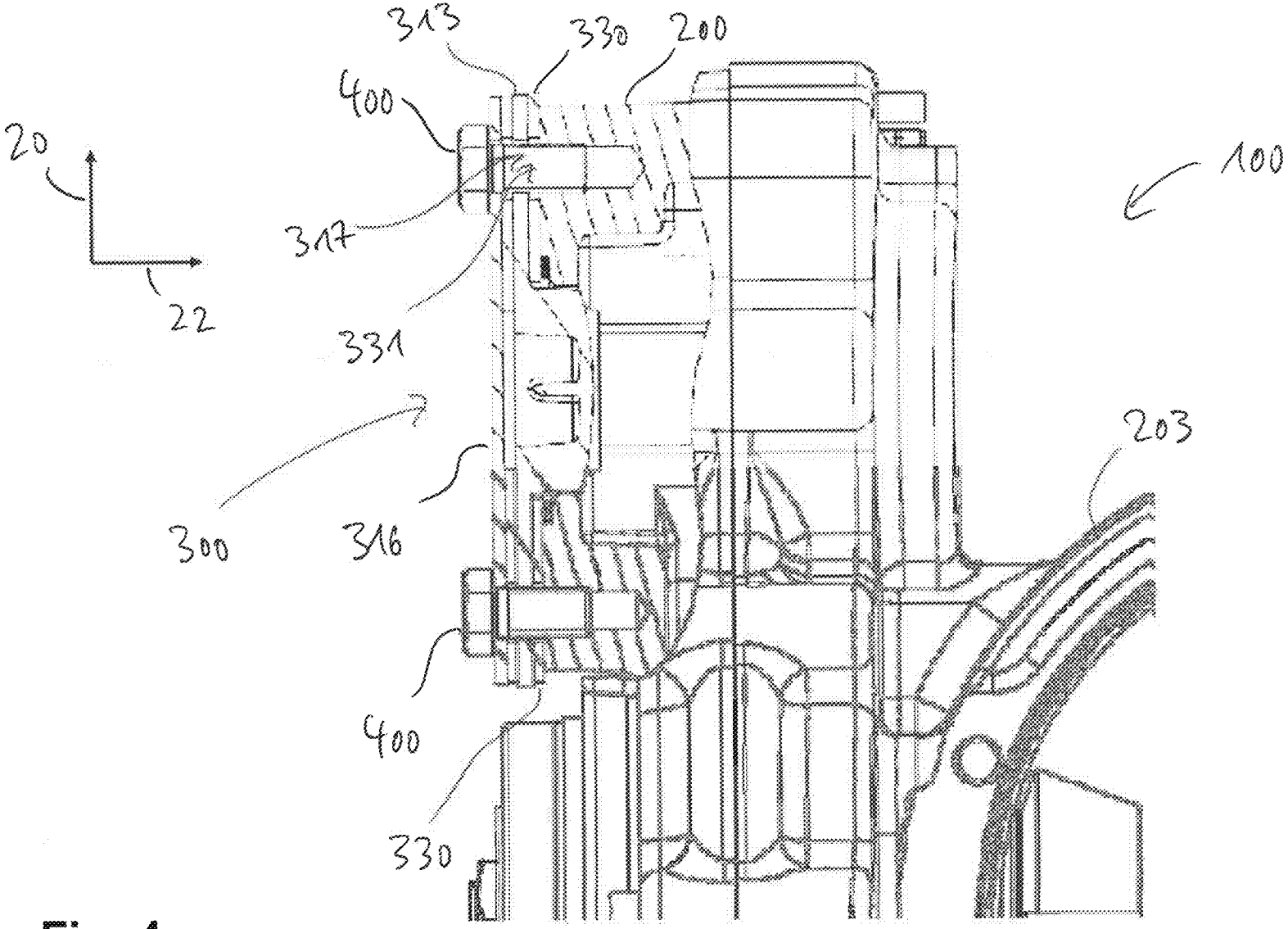
FIG. 4 schematically shows a second sectional view of a portion of the shipping assembly of FIGS. 1 and 2.
Figure 5:
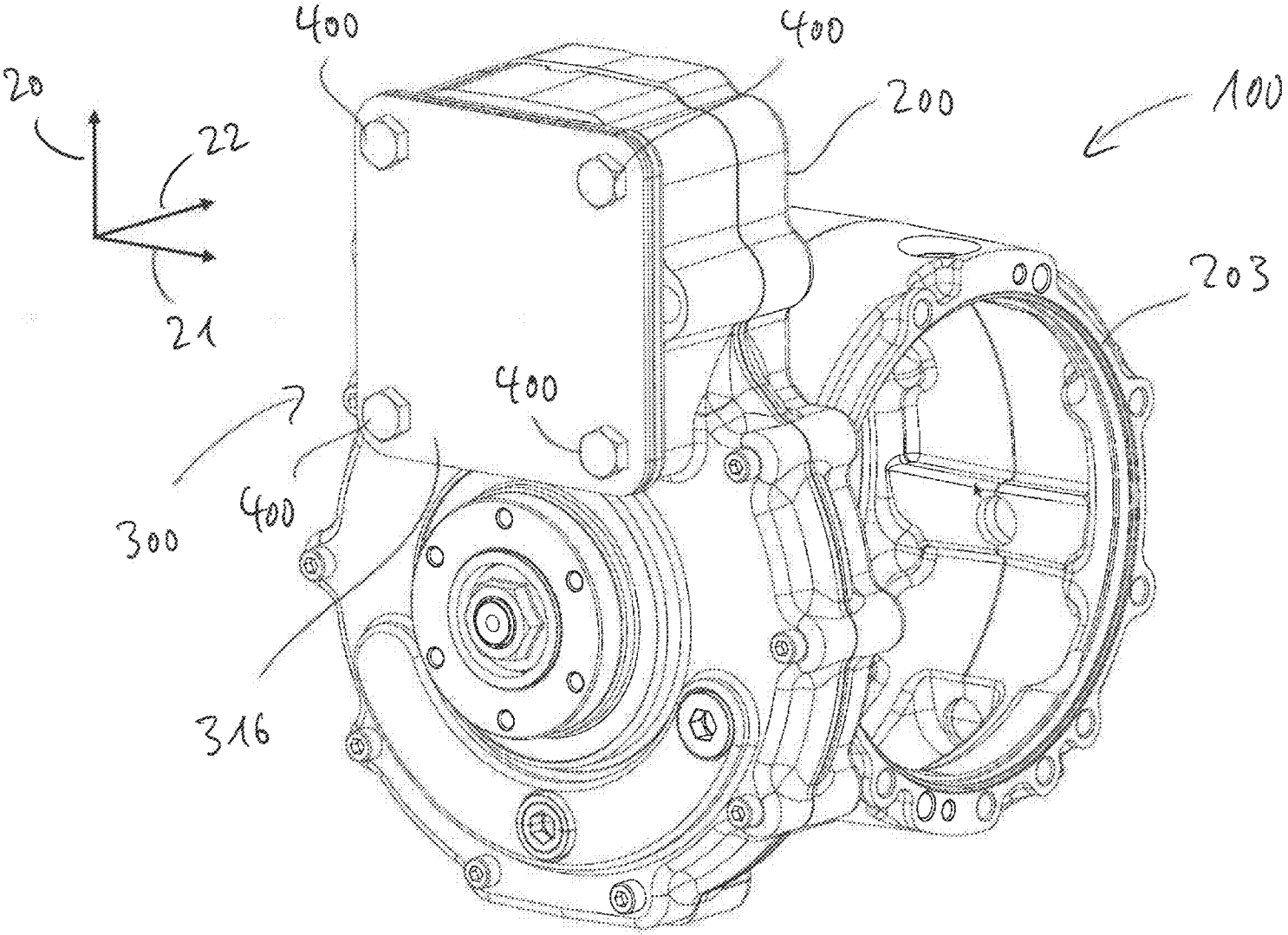
FIG. 5 schematically shows a perspective view of the shipping assembly of FIGS. 1 to 4.
Figure 6:
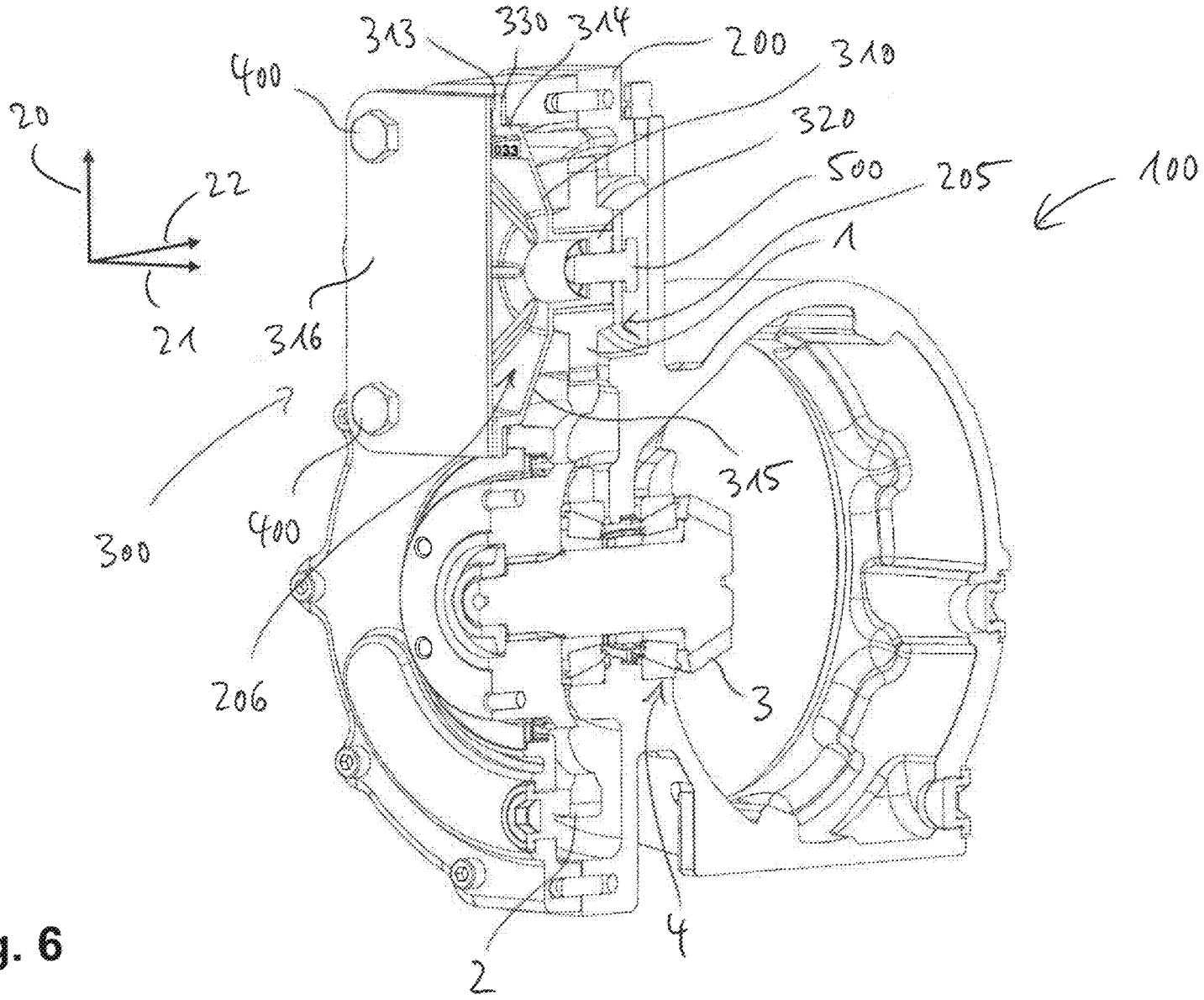
FIG. 6 shows a cutaway view of the shipping assembly of FIG. 5.

An embodiment of the shipping cover assembly 300 depicting some details of the stub shaft portion 320 and the receptacle 321 formed by the stub shaft portion 320 is shown in FIG. 3. In the embodiment illustrated in FIG. 3, the stub shaft portion 320 includes a cylindrical body portion 322 forming the essentially cylindrical receptacle 321. In FIG. 3, the stub shaft portion 320 further includes a plurality of resilient friction enhancing protrusions 323 disposed on and connected to an inner face of the cylindrical body portion 322 and protruding into the receptacle 321. As the fastening member 500 is inserted into the receptacle 321, the resilient friction enhancing protrusions 323 bend and give way to the fastening member 500, thereby enhancing friction between the stub shaft portion 320 and the fastening member 500 to secure the fastening member 500 in the receptacle 321. In the specific embodiment of the shipping cover assembly 300 shown in FIG. 3, the flange portion 313 has a square contour with rounded edges and the fitting portion 314 has a circular shape. However, it is understood that in alternative embodiments not explicitly depicted here the shipping cover assembly 300 and its components may have other shapes than explicitly illustrated in the figures.

The fact that the first gear 1 is mounted on the shipping cover assembly 300, or, more specifically, on the stub shaft portion 320, allows the shipping assembly 1 including the transmission housing 200 and the first gear 1 to be shipped and/or stored in a single package or as a single unit. Also, it may facilitate assembly of a transmission including the transmission housing 200 and the first gear 1.

In the embodiment depicted in the figures, the shipping cover assembly 300 further includes a sealing member 330. The sealing member 330 is disposed on the inner side 311 of the cover portion 310. More specifically, the sealing member 330 is disposed on the inner side 311 of the flange portion 313 of the cover portion 310. The sealing member 330 extends in parallel to the flange portion 313. The sealing member 330 extends circumferentially around the cover portion 310 or, more specifically, around the fitting portion 314 of the cover portion 310. In this way, when the cover portion 310 is received in or fully inserted into the open cavity 205 of the transmission housing, as shown for example in FIGS. 1 and 2, the sealing member 330 extends circumferentially around the opening 206 of the open cavity 205. Here, the sealing member 330 includes or is made of an elastomer, for example a thermoplastic elastomer (TPE). It is understood that in other embodiments not explicitly depicted here, the sealing member 330 may include or may be made of other materials. For example, the sealing member 313 may be injection-moulded on or glued to the inner side 311 of the cover portion 310 or, more specifically, on the inner side of the flange portion 314 of the cover portion 310. As can best be seen in FIGS. 3 and 4, the sealing member 330 includes through holes 331 which are aligned with the through holes 317 formed in the flange portion 313 of the cover portion 310 for receiving the connecting members 400.

When the cover portion 310 is fully inserted into the open cavity 205 of the transmission housing 200 and the connecting members 400 secure the shipping cover assembly 300 to the transmission housing 200, as shown in FIGS. 1 and 2, for example, the connecting members 400 press the sealing member 330 disposed on the inner side of the cover portion 310 into sealing contact with a sealing face 208 of the rim portion 207 of the transmission housing 200 which encloses the opening 206 of the open cavity 205 and extends circumferentially around the opening 206. In the embodiment depicted in the figures, the sealing face 208 of the rim portion 207 is arranged in parallel to the flange portion 313 of the cover portion 310.

For example, the sealing member 313 and the sealing face 208 formed on the rim portion 207 enclosing the opening 206 of the open cavity 205 may be configured to provide an air tight seal between the shipping cover assembly 300 and the transmission housing 200. In this way, no air or other fluids may escape from the transmission housing 200 through the opening 206 when the shipping cover assembly 300 closes the opening 206. For instance, this may allow performing a leakage test during end-of-line testing of the transmission housing 200. In this case, no further tools are required to seal the transmission housing 200 for the leakage test.

Figure 8:
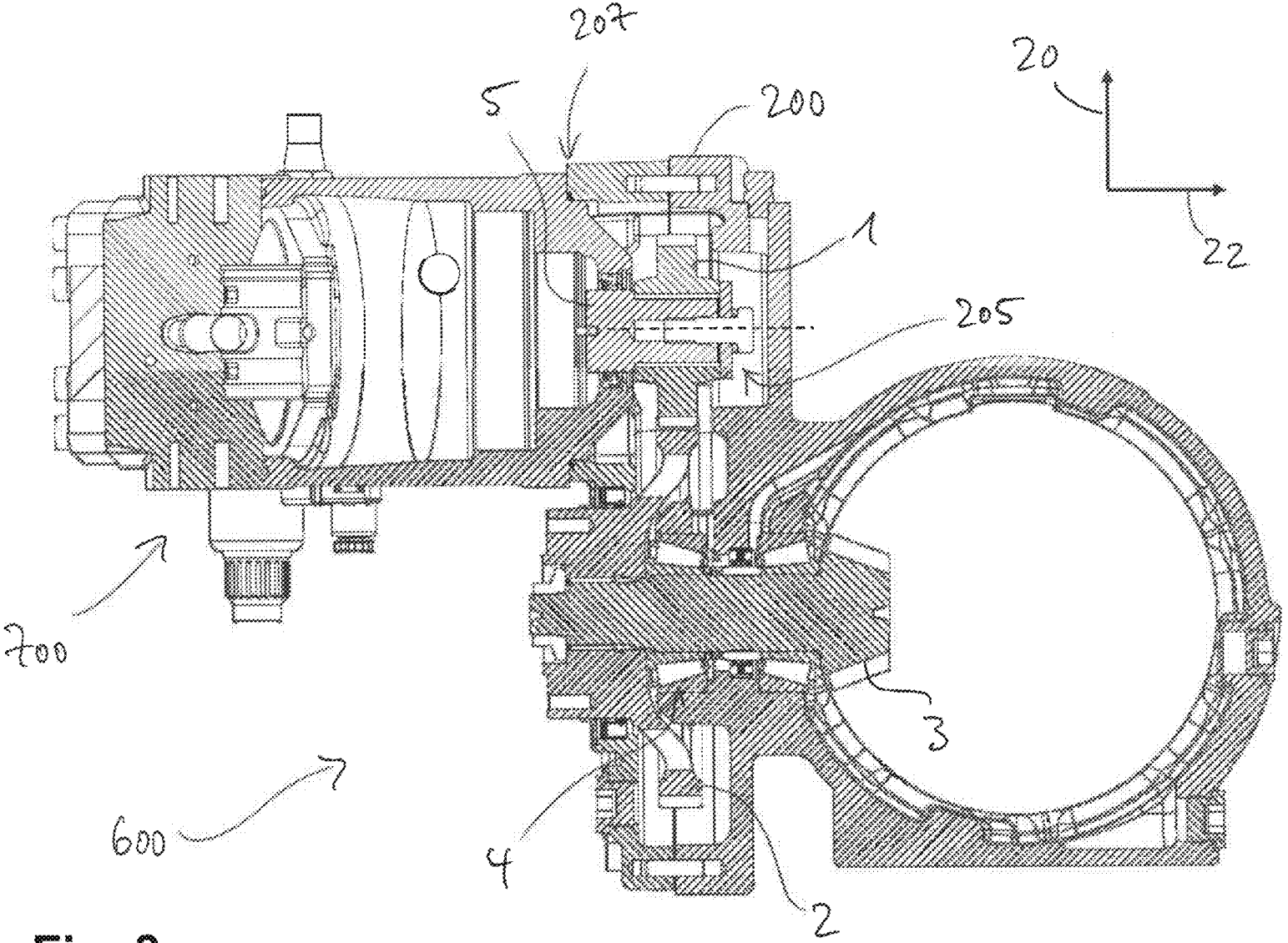
FIG. 8 schematically shows a sectional view of a transmission including the transmission housing depicted in FIG. 1, wherein a hydaulic motor is mounted on the transmission.

FIG. 8 shows a sectional view of an assembled state of a transmission 600 including the transmission housing 200 shown in the previous figures. The transmission 600 further includes the first gear 1 mounted on an input shaft 5, as well as the above-mentioned second gear 2 mounted on the pinion shaft 3 which is supported on the transmission housing 200 via the bearing 4. The input shaft 5 of the transmission 600 is drivingly connected to an output of a hydraulic motor 700 which is mounted on the transmission housing 200.

LIST OF REFERENCE SIGNS

1 first gear
1*a* through hole
1*b* rotation axis
2 second gear
3 pinion shaft
4 bearing
5 input shaft
20 x-axis
21 y-axis
22 z-axis
100 shipping assembly
200 transmission housing
201 first housing portion
202 second housing portion
203 axle housing
204 connecting elements
205 open cavity
206 opening
207 rim portion
208 sealing face
300 shipping cover assembly
310 cover portion
311 inner side
312 outer side
313 flange portion
314 fitting portion
315 tapered portion
315*a* end face of 315
316 lid
317 through holes
320 stub shaft portion
321 receptacle
322 body portion
323 friction enhancing protrusions

330 sealing member
331 through holes
400 connecting members
500 fastening member
500*a* body portion
500*b* head portion
510 washer
510*a* through hole
600 transmission
700 hydraulic motor

The invention claimed is:

1. A shipping cover assembly for a transmission housing, comprising:

a cover portion having an inner side, and a stub shaft portion protruding from the inner side of the cover portion, wherein the stub shaft portion is directly mated with a gear;

wherein the stub shaft portion includes a receptacle configured to detachably receive a fastening member that detachably secures the gear on the stub shaft portion.

2. The shipping cover assembly of claim 1, wherein the cover portion and the stub shaft portion are formed in one piece.

3. The shipping cover assembly of claim 1, wherein one or both of the cover portion and the stub shaft portion are made of a plastic material.

4. The shipping cover assembly of claim 1, further comprising a sealing member disposed on the inner side of the cover portion.

5. The shipping cover assembly of claim 4, wherein the sealing member extends circumferentially around the cover portion.

6. The shipping cover assembly of claim 4, wherein the sealing member is injection-moulded on or glued to the inner side of the cover portion.

7. The shipping cover assembly of claim 1, wherein the cover portion comprises a flange portion.

8. The shipping cover assembly of claim 7, wherein a sealing member is disposed on the inner side of the flange portion of the cover portion.

9. The shipping cover assembly of claim 7, wherein the cover portion includes a fitting portion configured to be received in an opening of the transmission housing, wherein the flange portion protrudes outwardly from the fitting portion at a right angle.

10. The shipping cover assembly of claim 9, wherein the cover portion includes a tapered portion connecting the stub shaft portion to the fitting portion.

11. The shipping cover assembly of claim 1, wherein the cover portion features a plurality of through holes for receiving connecting members configured to connect the cover portion to the transmission housing.

12. A shipping assembly, comprising:

a transmission housing forming an open cavity, a shipping cover assembly, comprising:

a cover portion connected to the transmission housing and closing the open cavity of the transmission housing, an inner side of the cover portion facing the transmission housing, and a stub shaft portion protruding from the inner side of the cover portion and into the open cavity of the transmission housing, and a gear directly mated with the stub shaft portion of the shipping cover assembly;

wherein the stub shaft portion includes a receptacle configured to detachably receive a fastening member that detachably secures the gear on the stub shaft portion.

13. The shipping assembly of claim 12, wherein the cover portion and the stub shaft portion of the shipping cover assembly are formed in one piece.

14. The shipping assembly of claim 12, wherein the receptacle formed by the stub shaft portion for limiting movement of the gear on the stub shaft portion.

15. The shipping assembly of claim 12, wherein the shipping cover assembly further includes a sealing member disposed on the inner side of the cover portion and in sealing contact with a sealing face of the transmission housing.

16. The shipping assembly of claim 15, wherein the sealing member extends circumferentially around the cover portion, and the sealing face of the transmission housing extends circumferentially around an opening of the open cavity of the transmission housing.

17. The shipping assembly of claim 15, wherein the sealing member is injection-moulded on or glued to the inner side of the cover portion.

18. The shipping assembly of claim 15, wherein the cover portion comprises a flange portion and the sealing member is disposed on the inner side of the flange portion of the cover portion.

19. The shipping assembly of claim 16, wherein the cover portion of the shipping cover assembly includes a fitting portion received in the opening of the open cavity of the transmission housing in a form-fit, wherein a flange portion of the cover portion protrudes outwardly from the fitting portion at a right angle, the flange portion of the cover portion thereby forming a mechanical stop which limits movement of the cover portion relative to the transmission housing.

* * * * *